United States Patent [19]

Masina

[11] Patent Number: 4,712,323

[45] Date of Patent: Dec. 15, 1987

[54] MULTIPLE BARREL RIFLE AND TRIGGER MECHANISM

[76] Inventor: Vittorino Masina, Via Novelli 732, S. Pietro in Casale (Bologna), Italy

[21] Appl. No.: 896,949

[22] Filed: Aug. 14, 1986

[30] Foreign Application Priority Data

Aug. 27, 1985 [IT] Italy ..... 3523 A/85

[51] Int. Cl.[4] ..... F41C 7/00; F41C 11/10; F41C 19/00

[52] U.S. Cl. ..... 42/42.01; 42/79; 42/76.01

[58] Field of Search ..... 42/40, 41, 42.01, 79, 42/76.01, 76.02

[56] References Cited

U.S. PATENT DOCUMENTS

| | | | |
|---|---|---|---|
| 161,300 | 3/1875 | Tubbs | 42/79 |
| 630,061 | 8/1899 | Lard | 42/42.01 |
| 863,431 | 8/1907 | Packer | 42/79 |
| 1,834,544 | 12/1931 | Klebe | 42/42.01 |
| 1,902,702 | 3/1933 | Jenkins | 42/42.01 |

FOREIGN PATENT DOCUMENTS

| | | | |
|---|---|---|---|
| 916491 | 8/1946 | France | 42/76.01 |
| 15307 | of 1903 | United Kingdom | 42/42.01 |

OTHER PUBLICATIONS

"Marlin Model 90 ST Shotgun", *Firearms Assembly* 3, (The NRA Guide to Rifles and Shotguns), p. 81.

*Primary Examiner*—Deborah L. Kyle
*Assistant Examiner*—Michael J. Carone
*Attorney, Agent, or Firm*—Karl F. Ross; Herbert Dubno

[57] ABSTRACT

The rifle presents the smooth-bore barrels, and the en-bloc having the maximum calibre and the same calibre constituting a set of three barrels, arranged, in section, in the form of an equilateral triangle, with lower vertex. The firing device, correspondingly, presents a set of three firing-pins, hammers and fixture levers, able to produce, with the single trigger, a progressive sequence of shots, providing, in combination with differentiated necks, specially designed, a complete range of types of shot.

4 Claims, 4 Drawing Figures

MULTIPLE BARREL RIFLE AND TRIGGER MECHANISM

FIELD OF THE INVENTION

The present invention relates to a rifle designed for small and medium game hunting, in particular a rifle which is single-triggered and swingable-breech closing, has three firing units combined with three barrels arranged in cross-section in an equilateral triangle with a downwardly pointing vertex, i.e. with two top barrels juxtaposed and one lower central barrel, and wherein the barrels have bores, in particular smooth, of a maximum caliber permitted by law.

BACKGROUND OF THE INVENTION

At the present stage of technology there exist three-barrel rifles that are heterogeneous in the sense that at least one of the barrels is of the rifled-bore type and thus is suitable for the firing of single-bullet so-called ball ammunition.

From the point of view of their operation, insofar as they permit a number of shots equal to that permitted by multiple barrel rifles, they are equivalent to semiautomatic rifles which enable one to fire as many as five homologous cartridges one after the other (although Italian law has a limit of three). The automatic rifles with only one barrel have the drawback that they provide the hunter with only with homogenous firing, although it would be very much more convenient to be able to have differentiated firing. This can only be obtained by having a variety of barrels, so that an appropriate neck may be used for each type of munition.

Again, from the point of view of the rifle's operation, there exist cartridges which have fundamentally the same structure as traditional pellet cartridges but which instead contain a single ball and which can therefore be fired from smooth-bore barrels. Also, cartridges that can be fired from rifled-bore barrels are of limited use, especially in terms of compliance with the law, and the rifle desired to fire such cartridges is affected by legal limitations which may also make use of the rifle conditional on blocking up the rifled-bore barrel.

OBJECTS OF THE INVENTION

The purpose of the present invention is to provide an improved multibarrel rifle which overcomes the drawbacks of earlier rifles.

SUMMARY OF THE INVENTION

This object is achieved in a rifle of essentially the same weight and size as a normal double-barrelled rifle or as a normal over-and-under rifle, but which is provided with three smooth-bore differentiated barrels, whose axes are positioned at the vertices of an equilateral triangle having a downwardly pointing vertex, connected by means of a single-trigger successive triple action firing mechanism. This combination enables the hunter, providing he is the bearer of a normal hunting permit, to hunt any animal that he is permitted to hunt up to the size of a wild boar, being able to use differentiated or differentiatable triple firing, simply by inserting the appropriate cartridges in the respective beeches.

BRIEF DESCRIPTION OF THE DRAWING

To explain more clearly the characteristics of this invention I shall refer to the accompanying drawing which illustrates a possible embodiment of the invention.

In the drawing

SPECIFIC DESCRIPTION

Figure 1:
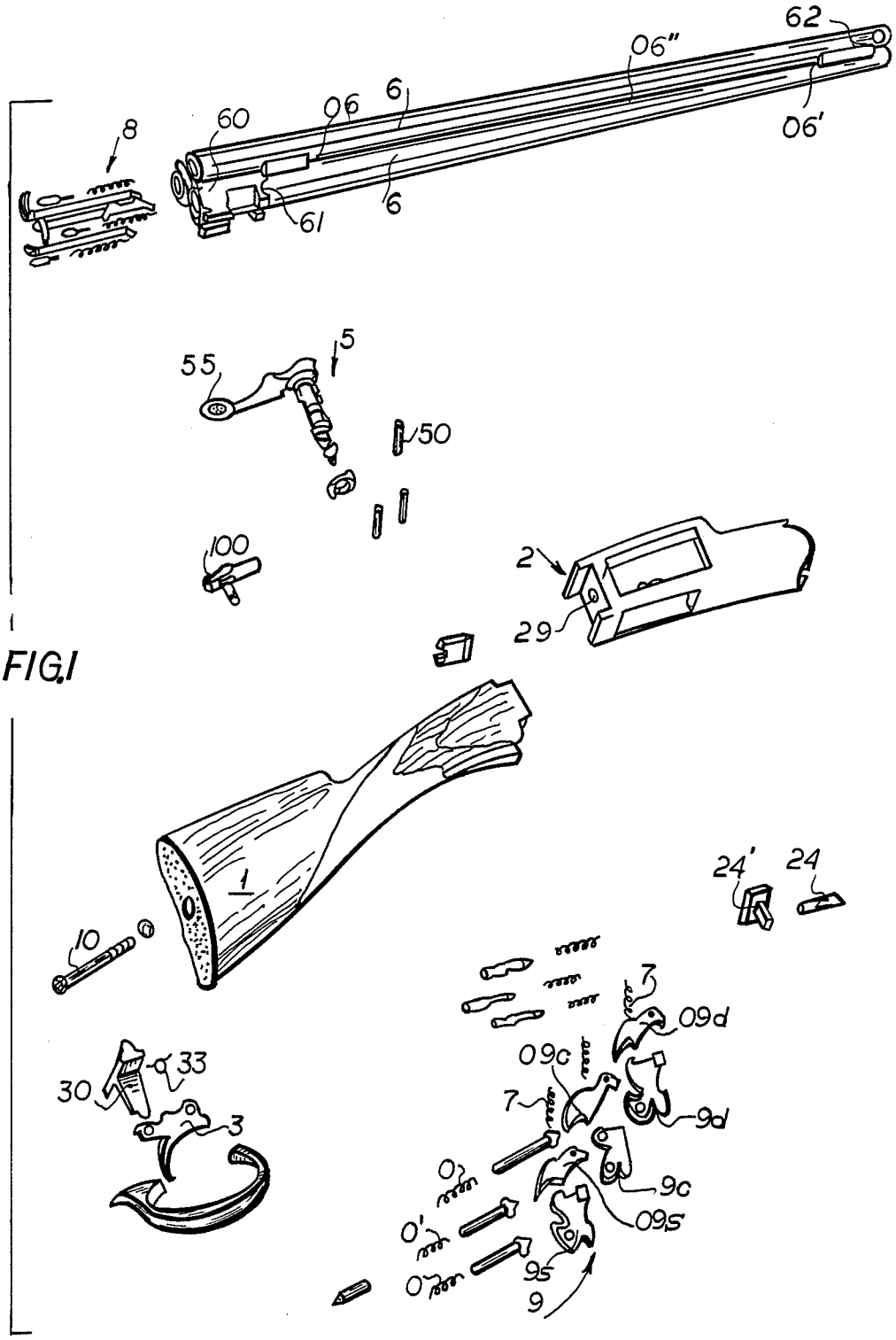
FIG. 1 is a perspective view of the operational parts of the rifle shown in exploded form for greater clarity.

The swingable-breech-closing small and medium game hunting rifle at the invention comprises the rifle butt 1, (FIG. 1) the swingable breech assembly 2 (FIGS. 1–4) including the trigger 3, the firing device 4, the closure device 5, and the body 20 of the swingable breech itself, a number of barrels 6 forming a barrel assembly (FIG. 1) appropriately provided with an enbloc 60 and extractor 8, at one end, as well as chokes 62 (only one of these is illustrated) at the other end, and a hinged rod, which is not illustrated.

In the conventional manner, the rifle butt[1] is fixed to the swingable breech 2 by means of the stay-rod 10 (FIG. 1) which is screwed into a seat 29 of swingable breech 2. In addition, the swingable breech is of the cradle type, characteristic of over-and-under barrel rifles and itself houses, with its own hinge pins 21, which are inserted into seats 61 (FIG. 1) enbloc 60, the said enbloc. The swinging operation of the bascule closure 2 has the effect of causing the excursion of at least one cock rod 24 (FIG. 1) and of stressing catch 50 of closure lever 55 (FIG. 1) which enables subsequent firing.

Figure 2:
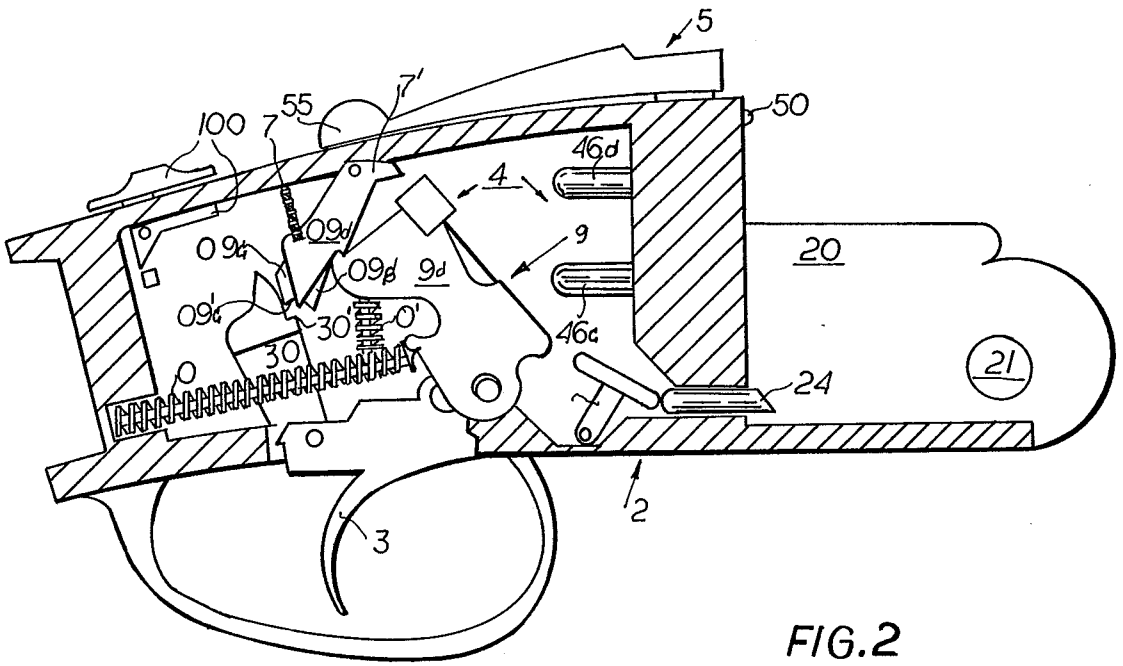
FIG. 2 is a cross-sectional view of the firing device in its position when the hammers are cocked.
Figure 3:
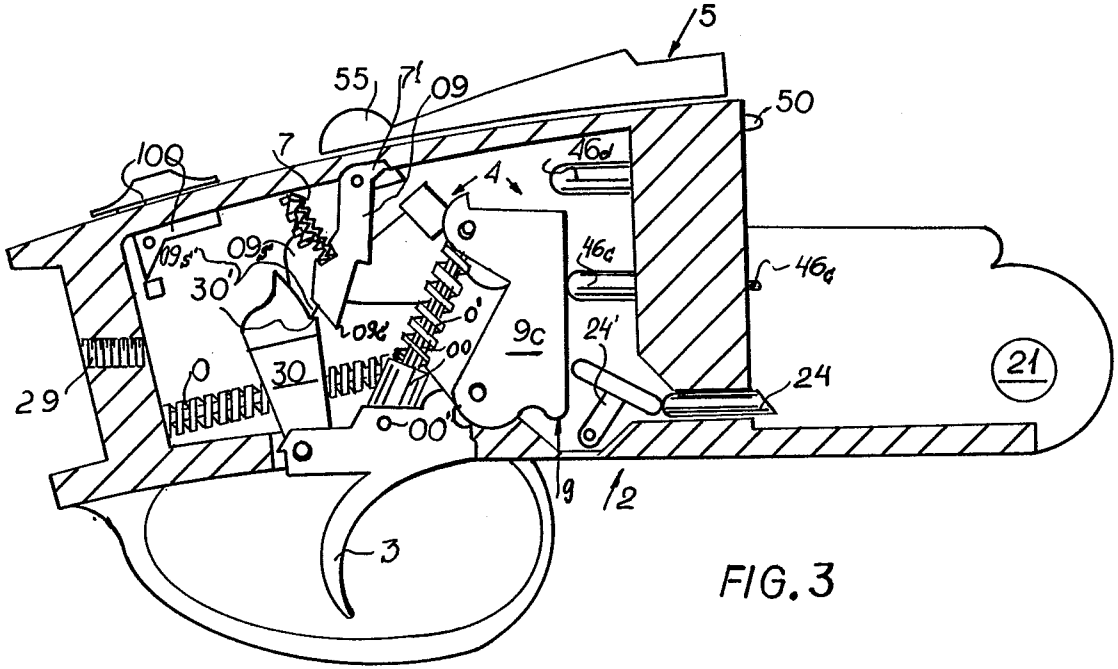
FIG. 3 is a view similar to FIG. 2 showing the firing device when the central hammer is uncocked, the right-hand hammer mechanism being omitted.
Figure 4:
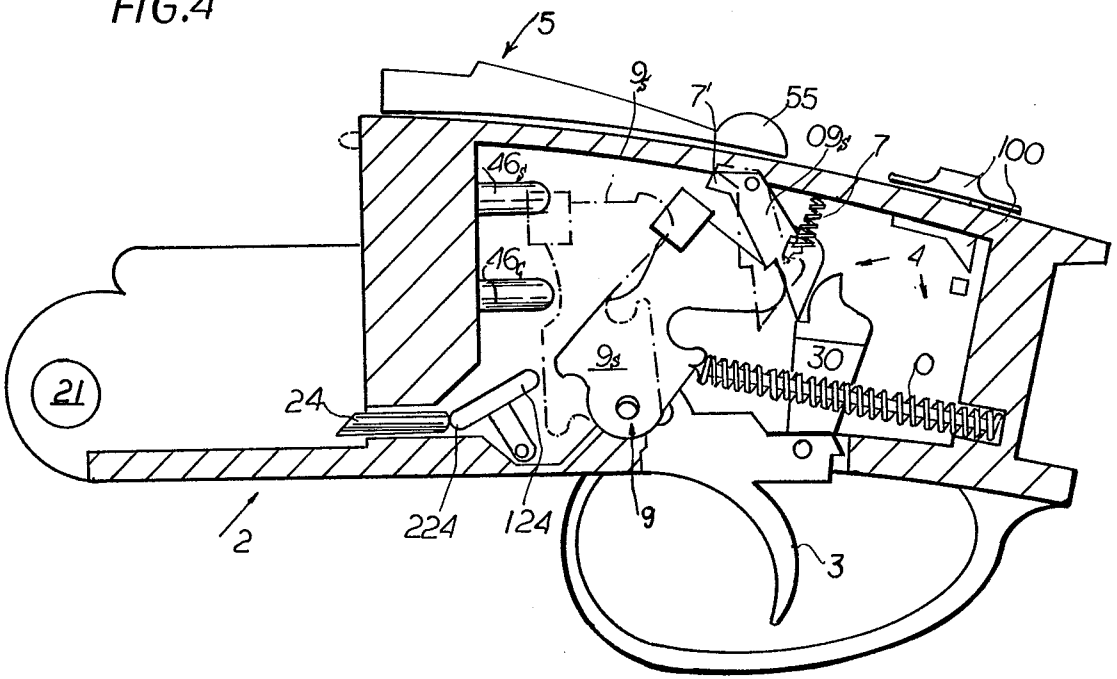
FIG. 4 is a view similar to FIG. 3 except that it is seen from the opposite side, therefore providing a view of the lefthand hammer, which is shown cocked in solid lines and uncocked in broken lines.

In addition, the excursion of the cock rod 24 loads by way of a guide 24', the hammer springs 0 for hammers **9*d* and 9*s*, and their fixture levers 09*d* and 09*s*, which are positioned respectively to the right and to the left, i.e. above or below the firing mechanisms, whereas the rocker arm 30, engaged by trigger 3, is kept permanently under stress, by spring 33, in a position suitable to the release of fixture or retaining levers 09*d* and 09*s* (FIGS. 2–4**).

To keep the description brief, and also because it is not relevant to the present invention, neither the safety catch 100 and how it works, nor the operation bascule-latching 5 or trigger 3, all of which are perfectly well-known and conventional will be described. The same applies to extractor 8.

As regards the hammer spring 0, which are loaded in the operation of cocking the rifle, and which correspond in number to the hammers generally represented 9, and in the case of the double-barrelled rifle, whether it be of the juxtaposed or of the over-and-under type, there are at least two of them, positioned alongside the rocker arm. According to the present invention, the bores of the barrels 6 and of the enbloc 60 are homogeneous and constitute a triad, having, in cross-section, the form of an equilateral triangle with a lower vertex. More precisely, there are two laterally juxtaposed barrels above the lower third one. In accordance with an arrangement preferred by the present invention, the three barrels 6 are all of the same bore which can be the maximum permitted by law, and are smooth-bore.

In accordance with another feature of this invention, the chokes 62 (only one of which is illustrated in the drawing) is scientifically differentiated in the three bores, in such a way as to provide for each barrel 6 a spread of pellets of the types that are associated with full choke, half choke and a perfectly cylindrical choke. This distribution of chokes can correspond to a succession of shots upon pulling the single trigger as follows: (1) the first shot is from the lower barrel which has a bore with a perfectly cylindrical choke, (2) the second shot is from the righthand upper barrel which has a half choke; and (3) the third shot is from the lefthand upper barrel which has a full choke.

Advantageously, the set of three barrels 6 is structured and organized in such a way that they have the same weight, for example 3.2 kg, and the same distribution of weight as a conventional juxtaposed twin-barrelled rifle, so that the center of gravity of the rifle is located exactly at the hingepin, which is the axis that scientific weapons rules recommend as optimal. This condition is obtained by using for construction of the barrels 6, a high strength steel with a wall thickness of 0.6 mm., and an arrangement in which the barrels are joined only at their ends 06, 06' (FIG. 1), in order also to facilitate cooling, as well as thermal expansion and contraction. In the 06-06' length between the joints 06 and 06' there is a sizable gap 06'' between one barrel 6 and another.

According to the invention, the firing element 4 features a central mechanism placed between the two basically conventional righthand and lefthand mechanisms. This centrally placed device consists of a fixture lever **09*c* and of a central hammer 9*c* and a correspondingly broader rocker pin, as well as a central firing pin 46*c* and the conventional accessory elements. In particular, in addition to the side springs 0 which lie parallel to one another and generally parallel to the barrels 6, there is at least one spring 0', the purpose of which is to cock central hammer 9*c* (FIGS. 2 and 3). This spring 0' is substantially perpendicular to the axes of springs 0 juxtaposed, and parallel in the cocked positions of the hammers (FIG. 2). The spring 0' may in fact assume either of two positions (compare FIGS. 2 and 3). The central spring 0' is mounted on a telescoping joint 00 hinged at 00'**.

The sequence in which the shots are fired basically depends on the configuration of fixture levers **09*d*, 09*c*, 09*s*. These are specially staggered so that they present to the rocker arm 30, or rather to its raising tooth 30', in each case and in the aforesaid sequence, the correct surface that is to engage with the tooth 30' and with the rocker arm 30 itself. The fixture levers 09*d*, 09*c*, 09*s* are caused to rotate counter clockwise (FIGS. 2 and 3) by retaining lever springs 7 and have a lip 7'** that limits their angular excursion in that direction.

From the description that has already been provided, it should now be obvious how the firing device works. A detailed description of its operation is however supplied below. With the excursion of rod 24 (upon closing of the breech), its inner end 24'' comes into contact with the arm 224 of the double lever 24', causing it to rotate in a counter-clockwise direction, at the same time as the other arm 124 cooperates with the triad of hammers **9*d*, 9*c*, 9*s*, which are thus rotated clockwise (FIG. 4 or counterclockwise (FIGS. 2 and 3), thereby compressing the three springs 0, 0', 0 (FIG. 2) respectively and cocking the hammers. The device 4 is then ready to fire from the single trigger 3**.

As may be seen from FIG. 2, the tooth 30' of rocker arm 30, or rather its corresponding chamber, is ready to engage first the surface **09*c'* of fixture lever 09*c* which in a way that is invisible (in this Figure) but identical to that of lever 09*d* is linked to the central hammer 9*c*. Pressing trigger 3, obviously in an counterclockwise direction (FIG. 4), the rocker arm 30, or rather its tooth 30', is raised, with the result that the fixture lever 09*c* rotates in a clockwise direction (FIGS. 2 and 3), thereby releasing the central hammer 9*c* (compare FIGS. 2 and 3). The said hammer then strikes the firing-pin 46*c* (FIG. 3), linked to the lower barrel 6, which is the barrel provided with a perfectly cylindrical choke. Thereupon, the central fixture lever 09*c* moves forward, at least its surface 09*c'*, thereby removing it from the rocker arm 30, or rather from its tooth 30', which then engages with the adjacent surface which is 09*d'* of the righthand fixture lever, as can easily be gathered from a glance at FIG. 2. If trigger 3 is pulled again, the sequence described above is repeated, with reference to the said righthand hammer 9*d*, with the clicking forward of the corresponding fixture lever 09*d* and the displaying of the surface 09*s'* of lefthand fixture lever 09*s*, which is thus engaged by rocker arm 30 (FIG. 4 in unbroken lines) for the last shot which occurs in the same manner (FIG. 4 in unbroken lines). It is quite apparent that, using a rifle of the kind described in this invention, a hunter, by making a choice of the cartridges (not illustrated here) that he inserts into each firing chamber 60''**, may program, reprogram, and harmonize his shots in accordance with the sequence most appropriate or advisable given weather or game conditions; the hunter would also be a position to adjust the firing sequence of his rifle in harmony with those of other hunters using the same kind of weapon. As regards the use of single-ball cartridges, these may be inserted either in one or in all of the three barrels, given that the structure does not affect the cartridges in any way. These conditions are distinctly advantageous, as compared to those provided by an automatic rifle, insofar as they enable the hunter to use the whole range of shot available as the game seeks to escape, from a position at close-range to a more distant position, between one shot and the next.

I claim:

1. A hunting rifle, comprising:

a barrel assembly comprising three mutually adjoining barrels having axes located at respective vertices of an equilateral triangle having a downwardly pointing vertex and including a lower centrally positioned barrel and a pair of laterally adjacent upper barrels, all of said barrels having the same bores but being formed with chokes set for different firing spreads;

a breech assembly swingably connected to said barrel assembly and comprising:

a breech closure forming a housing, a pair of outer hammers respectively juxtaposed with firing pins aligned with said upper barrels and swingably mounted in said housing, a central hammer disposed between said outer hammer, juxtaposed with a firing pin aligned with said lower barrel, and swingably mounted in said housing, respective coil hammer springs bearing upon said hammers and biasing same in the direction of the respective hammers, respective retaining levers pivotally mounted on said housing and engageable with said hammers for retaining the respective hammers in cocked positions, a trigger mounted in said housing, a rocker arm pivotally connected to said trigger in said housing and provided with a raising tooth positioned for successive engagement with said levers in a predetermined firing sequence for said hammers and said barrels whereby as said raising tooth successively engages said levers, said levers release the respective hammers, respective lever springs bearing upon said levers and swinging same out of the path of said tooth upon the release of the respective hammer by the respective lever whereby a subsequent pull on the trigger will permit said tooth to engage only the next lever to be released from the respective hammer in said sequence, a cock rod displaceable in said housing by the swinging of said breech assembly relative to said barrel assembly to close the breech of the rifle, and a cock lever in said housing displaceable by said cock rod and acting upon all of said hammers to compress said hammer springs and cock said hammers simultaneously; and a stock connected to said breech assembly.

2. The hunting rifle defined in claim 1 wherein said chokes include a choke providing a cylindrical spread, a half choke and a full choke, said barrels of said barrel assembly being connected together only at opposite ends of said barrel assembly and having longitudinal gaps between them, between said ends.

3. The hunting rifle defined in claim 2 wherein said hammer spring for said central hammer lies substantially perpendicular to said hammer springs for said outer hammers.

4. The hunting rifle defined in claim 3 wherein said tooth engages said retaining levers in a succession to fire the hammer of said lower barrel first, to fire the hammer of a right-hand one of said upper barrels second and to fire the hammer of the left-hand one of said upper barrels last.

* * * * *